US007461637B2

(12) United States Patent
Yamashita et al.

(10) Patent No.: US 7,461,637 B2
(45) Date of Patent: Dec. 9, 2008

(54) DIESEL ENGINE LUBRICATED WITH FUEL SUCH AS LIGHT OIL

(75) Inventors: Akira Yamashita, Susono (JP); Motoichi Murakami, Gotenba (JP); Tomoyuki Ono, Suntou-gun (JP); Hiroshi Moritani, Seto (JP); Toshihide Ohmori, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 27 days.

(21) Appl. No.: 10/592,005

(22) PCT Filed: Dec. 26, 2005

(86) PCT No.: PCT/JP2005/024204

§ 371 (c)(1),
(2), (4) Date: Sep. 7, 2006

(87) PCT Pub. No.: WO2006/070905

PCT Pub. Date: Jul. 6, 2006

(65) Prior Publication Data

US 2008/0035099 A1 Feb. 14, 2008

(30) Foreign Application Priority Data

Dec. 28, 2004 (JP) ..... 2004-380153

(51) Int. Cl.

| | |
|---|---|
| ***F02M 55/00*** | (2006.01) |
| ***F02M 37/02*** | (2006.01) |
| ***F02B 13/00*** | (2006.01) |
| ***F01M 1/02*** | (2006.01) |
| ***F01M 9/04*** | (2006.01) |
| ***F01M 11/02*** | (2006.01) |

(52) U.S. Cl. ..... 123/468; 123/445; 123/495; 123/575; 123/196 R

(58) Field of Classification Search ..... 123/196 R, 123/196 A, 73 A, 73 AD, 445, 468, 495, 123/575, FOR. 125
See application file for complete search history.

(56) References Cited

U.S. PATENT DOCUMENTS 4,787,348 A * 11/1988 Taylor ..... 123/198 A (Continued)

FOREIGN PATENT DOCUMENTS

DE 198 17 976 A1 11/1999

(Continued)

OTHER PUBLICATIONS

English translation of European Office Action, Appln. No. 05 851 005.8-1263, dated Nov. 14, 2007.

*Primary Examiner*—Michael Cuff
*Assistant Examiner*—Ka Chun Leung
(74) *Attorney, Agent, or Firm*—Kenyon & Kenyon LLP

(57) ABSTRACT

A diesel engine (1) includes a fuel supply passage (4) via which fuel is supplied from a fuel tank (2) to an oil pan (3) through a supply pump (6), a lubrication-system fuel supply passage (8) via which fuel is supplied from the oil pan (3) to engine parts (7) to be lubricated through a lubricating oil pump (10), and an injection-system fuel supply passage (13) via which fuel is supplied from the oil pan (3) to an injection system (12) through an injection pump (12).

4 Claims, 11 Drawing Sheets

U.S. PATENT DOCUMENTS

| | | | | |
|---|---|---|---|---|
| 6,209,508 | B1 | 4/2001 | Tinney | |
| 6,446,612 | B1 * | 9/2002 | Hankins et al. | 123/514 |
| 2002/0124834 | A1 | 9/2002 | Rembold et al. | |

FOREIGN PATENT DOCUMENTS

| | | | |
|---|---|---|---|
| FR | 834 339 | A | 11/1938 |
| FR | 2 817 917 | A1 | 6/2002 |
| GB | 720 222 | A | 12/1954 |
| JP | 55-081214 | | 6/1980 |
| JP | 56-027015 | | 3/1981 |
| JP | 57-008309 | | 1/1982 |
| JP | 60-194112 | | 12/1985 |
| JP | 2000-329008 | A | 11/2000 |

* cited by examiner

DIESEL ENGINE LUBRICATED WITH FUEL SUCH AS LIGHT OIL

This is a 371 national phase application of PCT/JP2005/024204 filed 26 Dec. 2005, claiming priority to Japanese Patent Application No. 2004-380153 28 Dec. 2004, the contents of which are incorporated herein by reference.

TECHNICAL FIELD

The present invention relates to diesel engines in which fuel such as light oil is used as lubricating oil.

BACKGROUND ART

A diesel engine lubricated with light oil is described in Japanese Utility Model Patent Application Publication No. 60-194112. This diesel engine has a reserver tank for bubble separation, which is disposed between a fuel tank and a diesel engine body. A lubrication-system fuel recycling circuit and a combustion-system fuel recycling circuit are provided between the reserver tank and the engine body. This type of fuel lubrication diesel engine uses light oil as not only fuel but also lubricating oil, and light oil lubricates parts of the engine body. Thus, there is no need for oil exclusive used for lubrication, and the trouble of oil exchange can be saved.

FIG. 11 schematically illustrates a fuel lubrication diesel engine 100 as described in the above-mentioned application, and mainly shows fuel supply systems thereof. The diesel engine 100 is equipped with a fuel tank 101, a reserver tank 102 having a combined function of a bubble separator, and an oil pan 103. The fuel tank 101 and the reserver tank 102 are connected via an oil passage composed of a water-oil separator (sedimenta) 104, and a supply pump (oil supplying pump) 105.

The diesel engine 100 has a lubrication-system fuel recycling circuit 108 that supplies fuel serving as lubricating oil to engine parts 107 necessary for supply of lubricating oil. The lubrication-system fuel recycling circuit 108 has a cooling device 112, a filter 109 and a lubricating oil pump 110. The lubricating oil pump 110 is driven to pump up fuel from the reserver tank 102 and supply it to the engine parts 107. The fuel that has lubricated the engine parts 107 flows down the engine body to the oil pan 103. Then, the fuel is pumped up by a scavenging pump 111 and is returned to the reserver tank 102.

The diesel engine 100 of fuel lubrication type has a fuel-system fuel recycling circuit 113, which supplies fuel to an injection system 114 that injects fuel into cylinders. The fuel-system fuel recycling circuit 113 has the cooling device 112 shared by the lubrication-system fuel recycling circuit 108, a filter 115 and an injection pump 116. The injection pump 116 is driven to pump up fuel from the reserver tank 102 and supply it to the injection system 114. Fuel that is supplied to the injection system 114 but is not used for combustion is returned to the reserver tank 102.

As described above, the diesel engine 100 of fuel lubrication type described in the above-mentioned application has two fuel recycling circuits, namely, the lubrication-system fuel recycling circuit 108 and the fuel-system fuel recycling circuit 113.

However, the diesel engine 100 has thee tanks, which are the fuel tank 101, the reserver tank 102, and the oil pan 103. Further, the diesel engine 100 has four pumps, that is, the supply pump 105, the lubricating oil pump 110, the injection pump 116 and the scavenging pump 111. Thus, the diesel engine 100 has a very complicated structure.

The diesel engine 100 has another problem. As described above, the fuel pumped up from the reserver tank 102 is supplied to the shared cooling device 112, and is then branched toward the lubricating oil pump 110 and the injection pump 116. Here, it should be noted that the lubricating oil pump 110 and the injection pump 116 have quite different discharge capacities and discharge pressures. When fuel is supplied to these pumps via the common supply port, the injection performance and the lubrication performance may be mutually affected.

DISCLOSURE OF THE INVENTION

The present invention has been made in view of the above-mentioned circumstances and provides a diesel engine lubricated with fuel such as light oil in which a reduced number of parts is used, and the lubricating oil pump and the fuel pump are prevented from being mutually affected.

According to an aspect of the present invention, there is provided a diesel engine including: a fuel supply passage via which fuel is supplied from a fuel tank to an oil pan through a supply pump; a lubrication-system fuel supply passage via which fuel is supplied from the oil pan to engine parts to be lubricated through a lubricating oil pump; and an injection-system fuel supply passage via which fuel is supplied from the oil pan to an injection system through an injection pump.

BRIEF DESCRIPTION OF THE DRAWINGS

Preferred embodiments of the present invention will be described in detail based on the following figures, wherein.

BEST MODE FOR CARRYING OUT THE INVENTION

Figure 1:
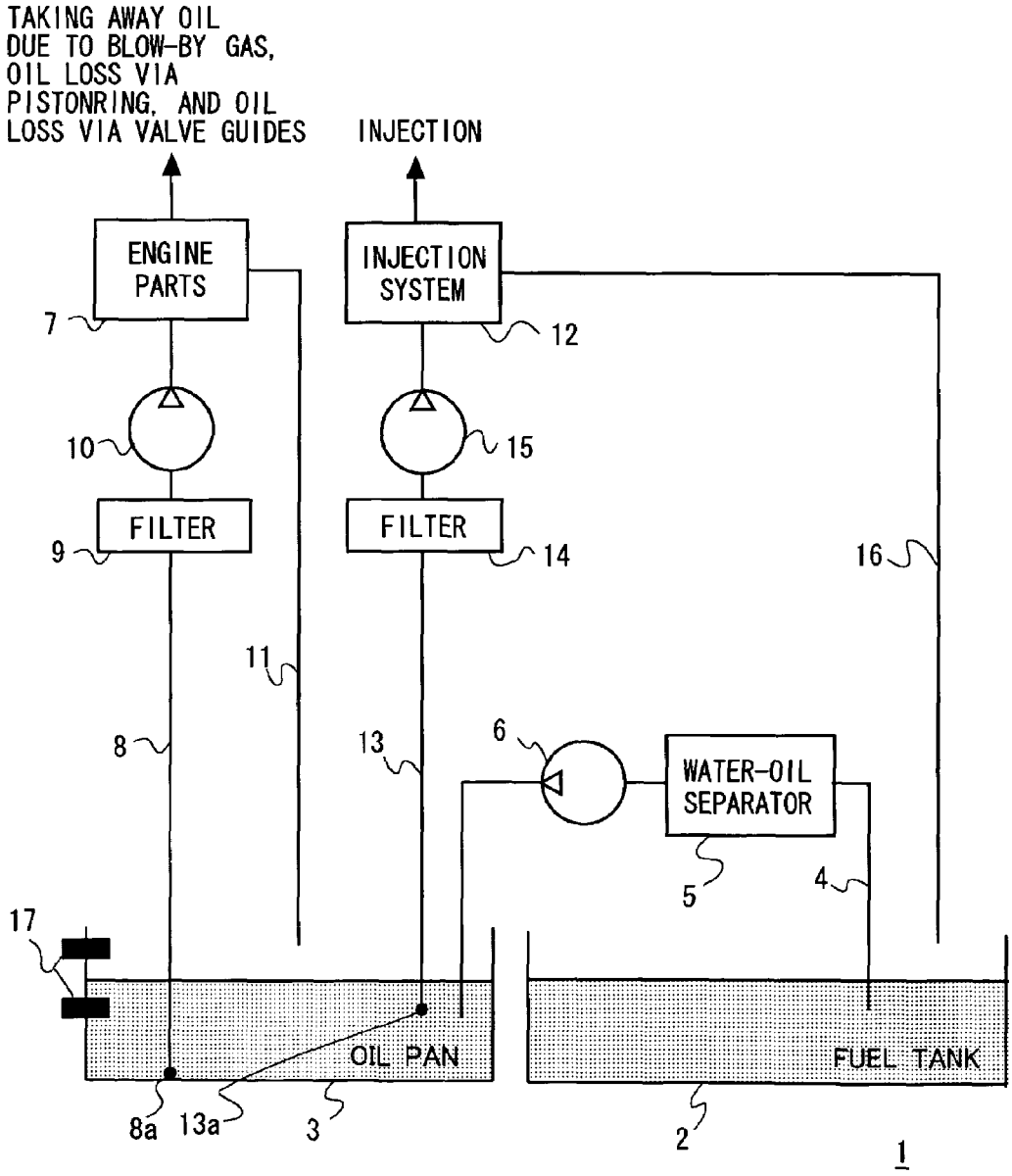
FIG. 1 illustrates a diesel engine lubricated with fuel in accordance with a first embodiment of the present invention.

FIG. 1 schematically illustrates a diesel engine lubricated with fuel such as light oil in accordance with a first embodiment of the present invention, and mainly shows fuel supply systems. A diesel engine 1 of fuel lubrication type is equipped with a fuel tank 2 and an oil pan 3, which are connected via a fuel supply passage 4. A water-oil separator (sedimenta) 5 and an electrically powered supply pump 6 are arranged in the fuel supply passage 4. The electrically powered supply pump 6 supplies fuel to the oil pan 3 from the fuel tank 2. The oil pan 3 may be a member integrally provided to the lower portion of a cylinder block. Alternatively, the oil pan 3 may be a separate oil tank.

The diesel engine 1 has a lubrication-system fuel supply passage 8 via which fuel serving as lubricating oil is supplied to engine parts 7 necessary for supply of lubricating oil. The lubrication-system fuel supply passage 8 is equipped with a filter 9 and a lubricating oil pump 10. The lubricating oil pump 10 has a capability of sending fuel to the engine parts 7 at a pressure of 50 to 400 kPa, and is driven to pump up fuel from the oil pan 3 and supply it to the engine parts 7. The engine parts 7 include parts that receive a supply of engine oil in conventional engines, such as the peripheral portions of the cylinder heads and the crankshaft.

The diesel engine 1 has a lubrication-system fuel return passage 11 used to return fuel that has been supplied to the engine parts 7 via the lubrication-system fuel supply passage 8 to the oil pan 3.

Further, the diesel engine 1 has an injection-system fuel supply passage 13, via which fuel is supplied to an injection system 12 that injects fuel into the cylinders. The injection-system fuel supply passage 13 includes a filter 14 and an injection pump 15 capable of sending fuel to the injection system 12 at a pressure as high as 10 MPa or higher. The injection pump 15 is driven to pump up fuel from the oil pan 3 and supply it to the injection system 12.

The diesel engine 1 has an injection-system fuel return passage 16 used to return injection-system return fuel that has been supplied to the injection system 12 via the injection-system fuel supply passage 13 to the fuel tank 2. The injection-system return fuel is fuel that is returned from a supply pump (low-pressure pump of the two-step boosting) integrally provided to the injection pump 15, a common rail and fuel injection valves (these parts are not shown for the sake of convenience).

A suction port 13*a* of the injection-system fuel supply passage 13 located in the oil pan 3 is located at a position higher than that at which a suction port 8*a* of the lubrication-system fuel supply passage 8 is located. An oil level sensor 17 is provided to the oil pan 3.

The electrically powered supply pump 6 is connected to a not-shown ECU (Electronic Control Unit). The oil level sensor 17 and various sensors for the diesel engine 1 are connected to the ECU, which controls the amount of discharge by an instruction signal based on the operating condition of the diesel engine 1.

The diesel engine 1 thus configured has the lubrication-system fuel supply passage 8 and the injection-system fuel supply passage 13 as two independent systems. It is thus possible to prevent the lubricating oil pump 10 and the injection pump 15 having quite different discharge capacities and discharge pressures from being mutually affected and to realize the desired lubrication performance and the desired injection performance on the basis of the engine operating condition. More specifically, the lubricating oil pump 10 continuously injects fuel at a pressure of 50-400 kPa. In contrast, the injection pump 6 injects fuel at a pressure as high as 10 MPa or higher and has a driving pattern such that injection step and the pressure-sending step are repetitively carried out. That is, the pumps 10 and 15 have quite different performances. The diesel engine 1 has the two mutually independent fuel supply systems that are the lubrication-system fuel supply passage 8 and the injection-system fuel supply passage 13, so that the desired lubrication performance and the desired injection performance based on the engine operating condition can be achieved.

It is also possible to reduce the length of the injection-system fuel supply passage 13 and improve the efficiency of the injection pump 15. In case where fuel is directly supplied to the injection system 12 from the fuel tank 2, a long injection-system fuel supply passage will be needed because the engine body is usually mounted on the front side of the vehicle and the fuel tank 2 is mounted on the rear side thereof. In contrast, the diesel engine 1 in accordance with the first embodiment has a mechanism such that fuel is pumped up from the oil pan 3 attached to the lower portion of the engine body. It is thus possible to shorten the injection-system fuel supply passage 13.

The diesel engine 1 is designed to return, to the fuel tank via the injection-system fuel return passage 16, the injection-system return fuel that is supplied to the injection system 12 via the injection-system return passage 16 and is raised at a high temperature. It is thus expected that the injection-system return fuel is cooled through the injection-system fuel return passage 16. This restrains temperature increase in fuel in the injection system 12. Usually, the fuel tank 2 is mounted on the rear side of the vehicle and the engine body is mounted on the front side, so that the injection-system return passage 16 is inevitably long. The long injection-system return passage 16 facilitates cooling the fuel returned to the fuel tank 2. A further fuel cooling effect is expected because the fuel from the injection system 12 is turned to the fuel tank 2 having a large capacity and is mixed with a large amount of existing fuel.

In the diesel engine 1, the fuel in the oil pan 3 is injected and consumed by the injection system 12, and the fuel supplied to the engine parts 7 is consumed by taking away oil due to blow-by gas, oil loss via the piston ring and oil loss via the valve guides. Taking the above into consideration, the electrically powered supply pump 6 is driven to supply the fuel to the oil pan 3 from the fuel tank 2 on the basis of the engine operating condition determined by the output signal of the oil level sensor 17 and those of other sensors. With this structure, it is possible to always store an appropriate amount of fuel in the oil pan 3.

If the fuel in the fuel tank 2 becomes empty, the oil pan 3 will also be empty. Taking the above into consideration, the saction port 13*a* of the injection-system fuel supply passage 13 located in the oil pan 3 is located at a position higher than that at which the suction port 8*a* of the lubrication-system fuel supply passage 8 is located. With this structure, it is possible to stop supplying fuel to the injection-system fuel supply passage 13 prior to stopping the supply of fuel to the lubrication-system fuel supply passage 8. That is, even after the diesel engine 1 is shut down, fuel may be continuously pumped up to the lubrication-system fuel supply passage 8 and supplied to the engine parts 7. It is thus possible to prevent the seizure of the diesel engine 1 due to lubrication breakdown.

Alternatively, it is possible to sense the empty state of the oil pan 3 by using the oil level sensor 17 and stop operating the injection pump 15 prior to the lubricating oil pump 10.

Figure 2:
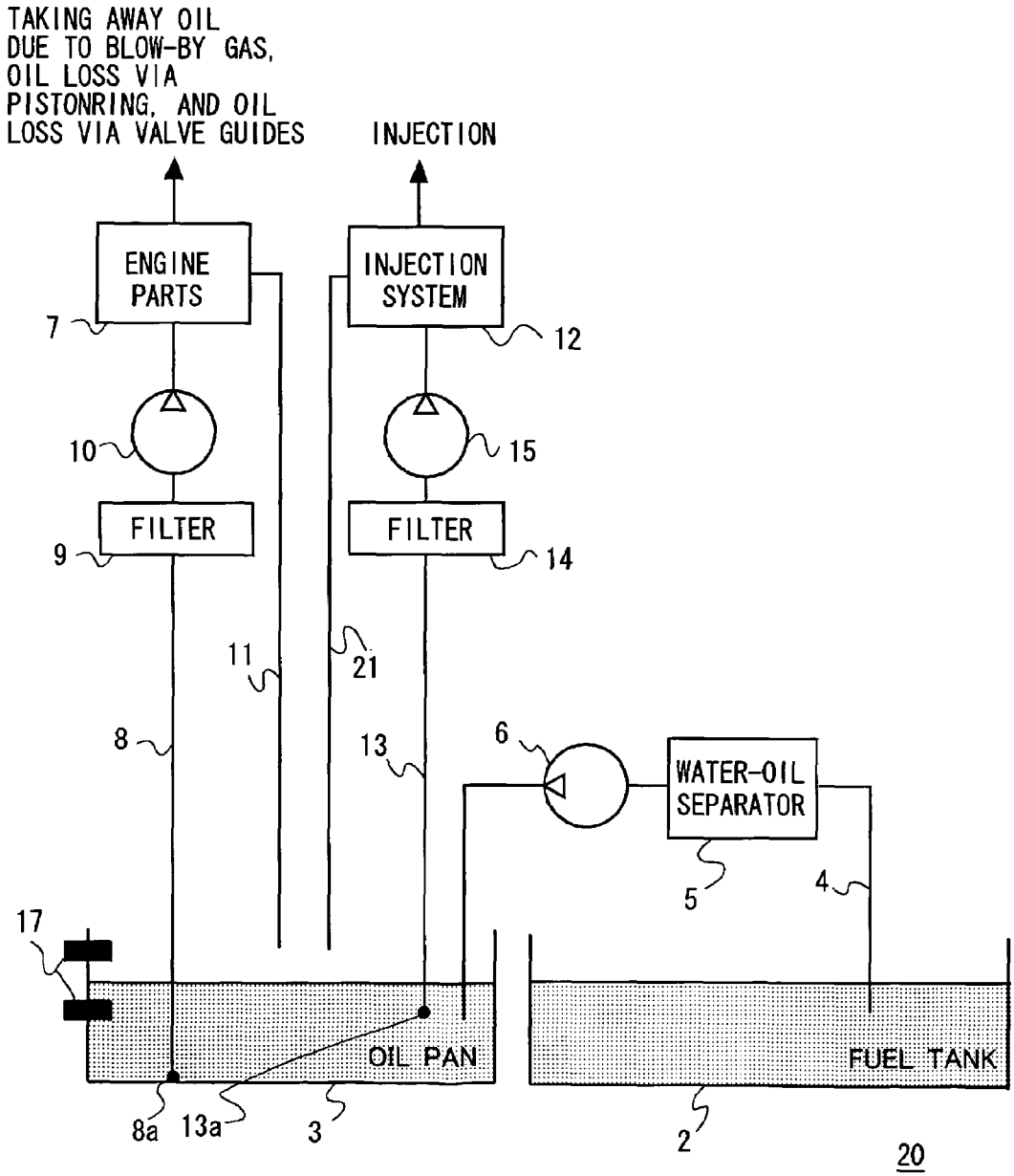
FIG. 2 illustrates a diesel engine lubricated with fuel in accordance with a second embodiment of the present invention.

A description will now be given, with reference to FIG. 2, of a diesel engine in accordance with a second embodiment of the present invention. A diesel engine 20 shown in FIG. 2 differs from the above-mentioned diesel engine 1 in the following. The diesel engine 1 has the injection-system fuel return passage 16 via which the return fuel after the supply to the injection system 12 is returned to the fuel tank 2. In contrast, the diesel engine 20 has an injection-system fuel return passage 21 via which the return fuel after the supply to the injection system 12 is turned to the oil pan 3.

With this structure, the injection-system fuel return passage 21 can be shortened, and the degree of freedom of mounting the diesel engine 20 can be improved.

The other structures of the diesel engine 20 are the same as corresponding those of the diesel engine 1. Thus, the parts commonly used in the diesel engines 1 and 20 are given the same reference numerals, and a description thereof will be omitted.

Figure 3:
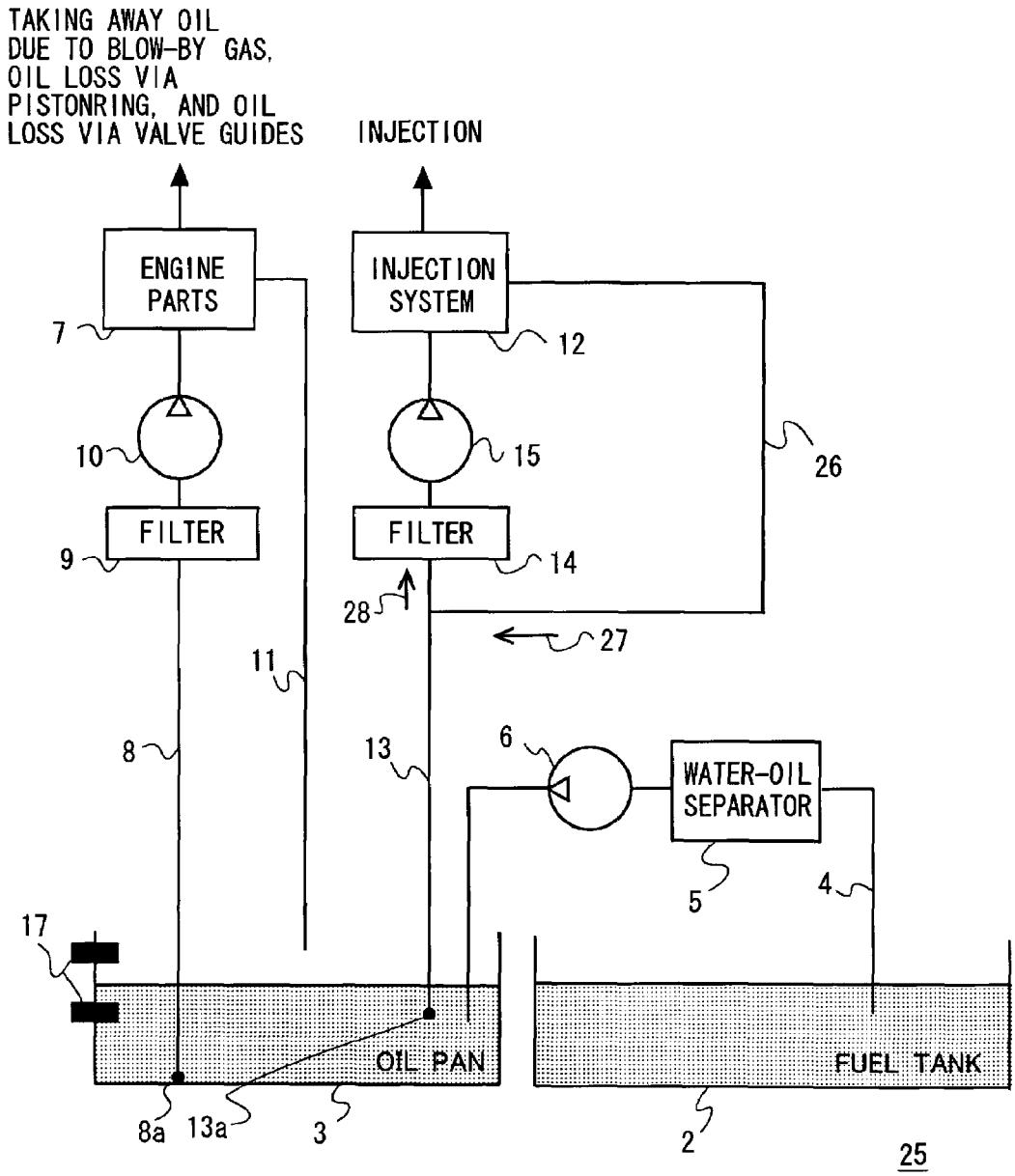
FIG. 3 illustrates a diesel engine lubricated with fuel in accordance with a third embodiment of the present invention.

Referring to FIG. 3, there is illustrated a diesel engine 25 in accordance with a third embodiment of the present invention. The diesel engine 25 differs from the diesel engine 1 of the first embodiment in the following. The diesel engine 1 has the injection-system fuel return passage 16 via which the return fuel after the supply to the injection system 12 is returned to the fuel tank 2. In contrast, the diesel engine 25 has an injection-system fuel return passage 26 via which the return fuel after the supply to the injection system 12 is returned to the upstream side of the injection pump 15.

With this structure, it is possible to shorten the injection-system fuel return passage 26 and improve the degree of freedom of mounting the diesel engine 25. In addition, it is possible to prevent fuel supplied to the injection system 12 from the oil pan 3 and smudged from being returned to the oil pan 3 and to positively supply the smudged fuel to the injection system 12 and combust it. This improves the reliability of the injection system 12.

As shown in FIG. 3, the injection-system return fuel is returned to the upstream side of the filter 14 arranged on the upstream side of the injection pump 15, as indicated by arrows 27 and 28. Thus, the return fuel is supplied to the injection system 12 after filtered by the filter 14. Even if the return fuel is mixed with a foreign matter, the filter 14 removes the foreign matter, which is not supplied to the injection system 12. It is also possible to separate bubbles from the return fuel and avoid air ration in the injection system 12.

The other structures of the diesel engine 25 are the same as corresponding those of the diesel engine 1. Thus, the parts commonly used in the diesel engines 1 and 25 are given the same reference numerals, and a description thereof will be omitted.

Figure 4:
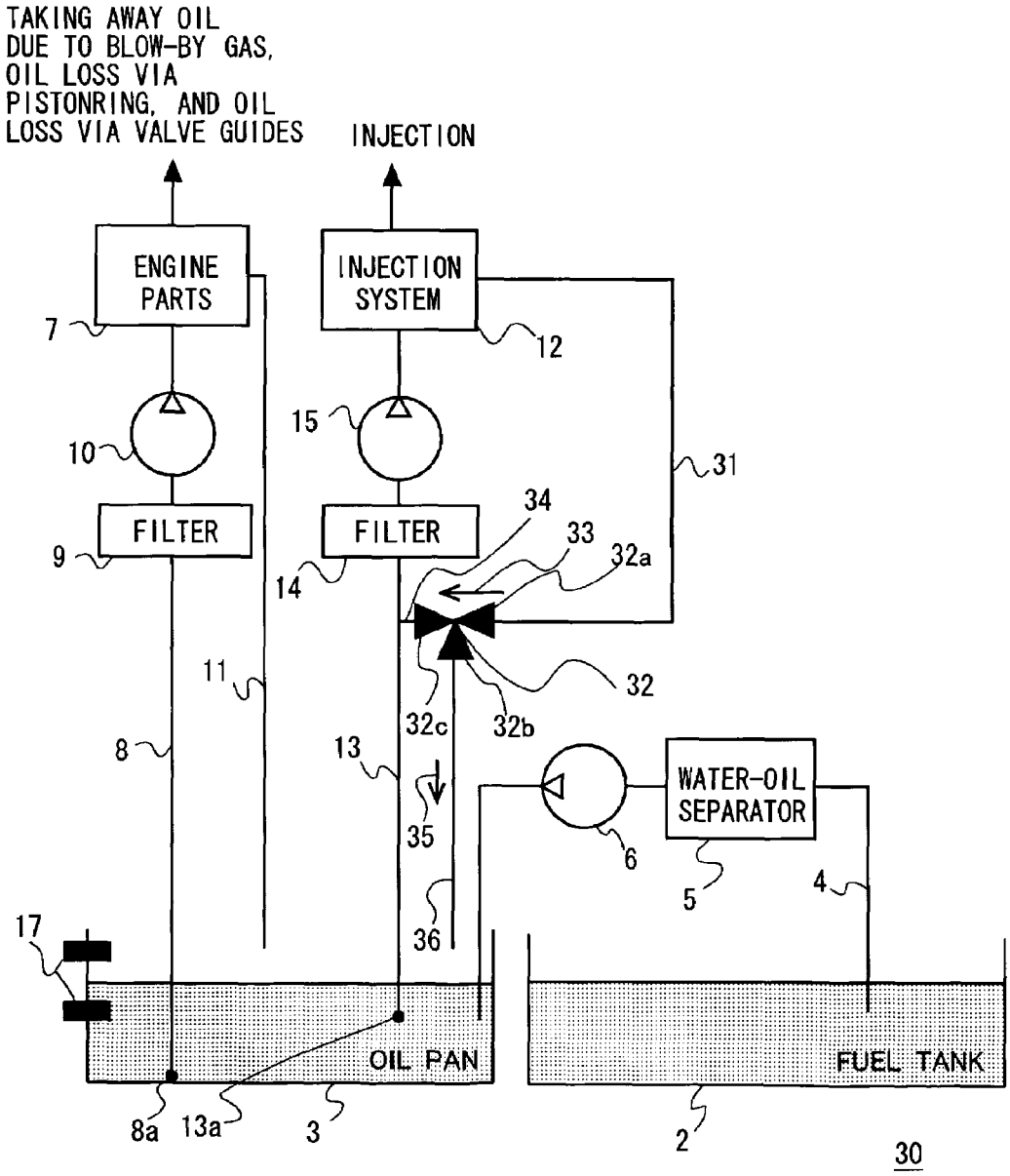
FIG. 4 illustrates a diesel engine lubricated with fuel in accordance with a fourth embodiment of the present invention.

Referring to FIG. 4, there is illustrated a diesel engine 30 in accordance with a fourth embodiment of the present invention. The diesel engine 30 differs from the diesel engine 1 of the first embodiment in the following. The diesel engine 1 has the injection-system fuel return passage 16 via which the return fuel after the supply to the injection system 12 is returned to the fuel tank 2. In contrast, the diesel engine 30 has an injection-system fuel return passage 31 via which the return fuel that has been supplied to the injection system 12 is returned to the oil pan 3 and the upstream side of the injection pump 15.

The injection-system fuel return passage 31 has a three-way valve 32, a first passage 34 and a second passage 36. The three-way valve 32 has three ports 32*a*, 32*b* and 32*c* and the degree of opening thereof can be adjusted. The first passage 34 is used to return the return fuel from the injection system 12 to the upstream side of the injection pump 15 as indicated by an arrow 33. The second passage 36 is used to return the return fuel from the injection system to the oil pan 3 as indicated by an arrow 35. The three-way valve 32 is capable of not only switching between the first passage 34 and the second passage 36 but also distributing the return fuel to the first passages 34 and 36 with a desired ratio. The three-way valve 32 may supply the return fuel to the injection pump 15, that is, the first passage 34 with an increased ratio when the diesel engine 30 is already warmed up. In contrast, the three-way valve 32 may supply the return fuel to the oil pan, that is, the second passage 36 with an increased ratio when the diesel engine 30 is cold.

The reasons for returning the return fuel from the injection system 12 to the oil pan 3 are as follows. The fuel in the oil pan 3 is supplied to the lubrication-system fuel supply passage 8 as well as the injection-system fuel supply passage 13, and functions as a lubricating oil. It is therefore desired that the fuel has an appropriate viscosity. When the engine is cold, the fuel is at a low temperature and a high viscosity. Thus, the temperature of fuel should be raised as soon as possible when the engine is cold. In this regard, it is convenient to return, to the oil pan 3, the fuel that has been supplied to the injection system 12 and has been raised to high temperature. On the other hand, it is required to prevent fuel from being excessively heated after the engine is warmed up. Taking the above into consideration, the three-way valve 32 is controlled based on the temperature of fuel to increase the degree of opening of the port 32*b* so that an increased amount of return fuel is fed to the oil pan 3 and the diesel engine 30 is warmed up quickly. This contributes to reduction of frictions in the diesel engine 30 and improvement in fuel economy. A temperature sensor (oil temperature sensor) may be used to determine whether the diesel engine 30 is already warmed up or cold. Such a temperature sensor may be attached to the oil pan 3 or the injection side of the injection pump 15. Instead of the oil temperature sensor, it is possible to use a water temperature sensor that senses the temperature of the engine cooling water.

In the diesel engine 30, the first passage 34 via which the return fuel from the injection system 12 is returned to the injection pump 15 is connected to the upstream side of the filter 14 connected to the upstream side of the injection pump 15. Thus, even if the return fuel is mixed with a foreign matter, the filter 14 removes the foreign matter, which is not supplied to the injection system 12. It is also possible to separate bubbles from the return fuel and avoid air ration in the injection system 12. These advantages are the same as those brought about by the diesel engine 25 of the third embodiment.

The other structures of the diesel engine 30 are the same as corresponding those of the diesel engine 1. Thus, the parts commonly used in the diesel engines 1 and 30 are given the same reference numerals, and a description thereof will be omitted.

Figure 5:
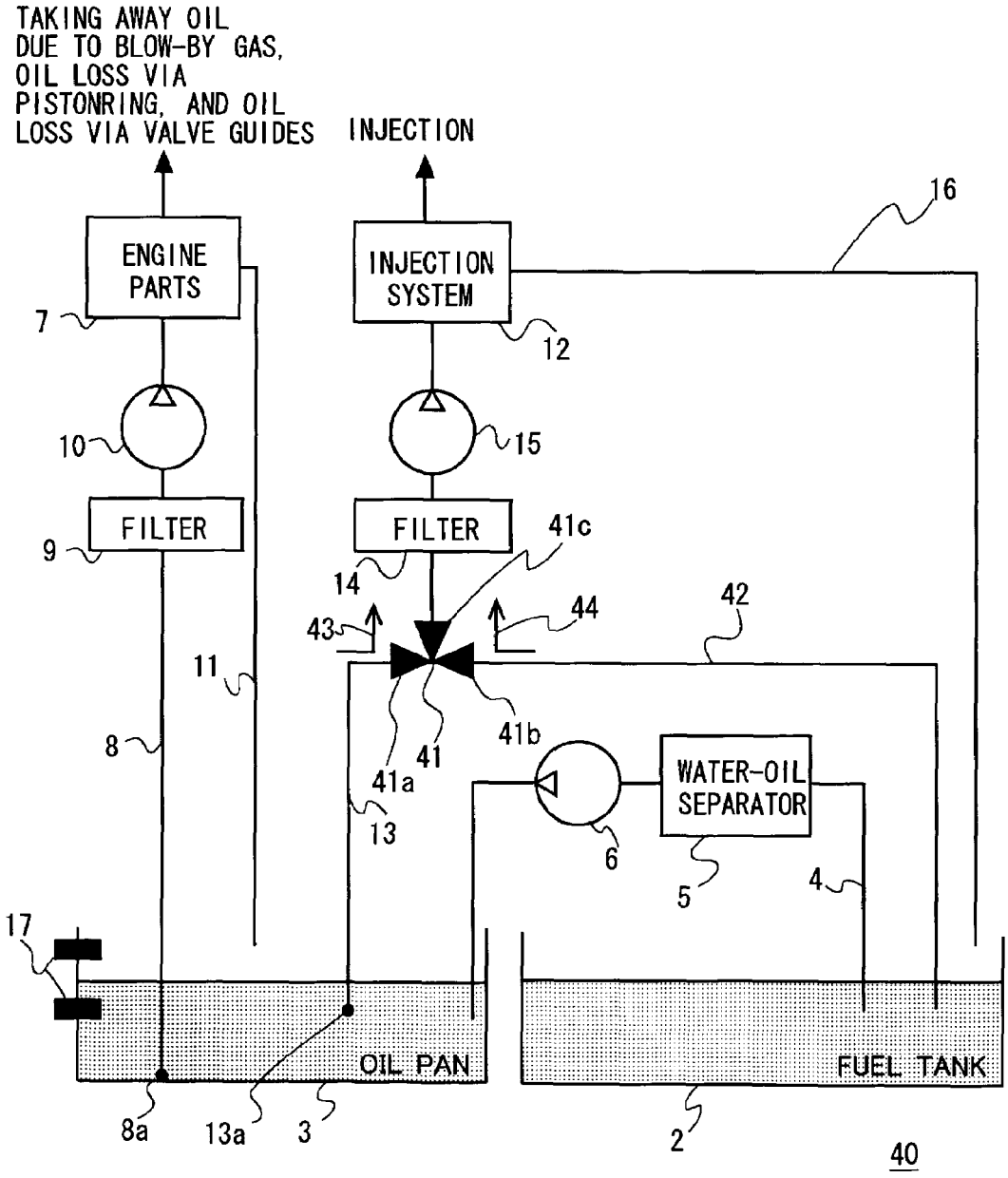
FIG. 5 illustrates a diesel engine lubricated with fuel in accordance with a fifth embodiment of the present invention.

Referring to FIG. 5, there is illustrated a diesel engine 40 in accordance with a fifth embodiment of the present invention. The diesel engine 40 differs from the diesel engine 1 of the first embodiment in the following. The diesel engine 1 has the injection-system fuel supply passage 13 in which the injection pump 15 pumps up fuel from the oil pan 3 only. In contrast, the diesel engine 40 of the fifth embodiment has a mechanism such that fuel is pumped up from the fuel tank 2 as well as the oil pan 3. As shown in FIG. 5, the injection-system fuel supply passage 13 has a three-way valve 41 provided on the upstream side of the injection pump 15 and connected to a fuel pipe 42 via which fuel is supplied from the fuel tank 2. That is, the diesel engine 40 is capable of directly pumping up fuel from the fuel tank 2.

The three-way valve 41 has three ports 41*a*, 41*b* and 41*c*, and the degree of opening thereof can be adjusted based on the temperature of fuel. When the temperature of fuel is lower than a given temperature, the degree of opening of the three-way valve 41 is controlled to pump up fuel from the oil pan 3, as indicated by an arrow 43. When the temperature of fuel reaches the given temperature, the degree of opening of the three-way valve 41 is controlled to pump up fuel from the fuel tank 2, as indicated by an arrow 44. The pumping-up ratio for the fuel tank 2 and the oil pan 3 may be changed based on the temperature of fuel.

With the above-mentioned structure, it is possible to supply the injection system 12 with fuel at a temperature as low as possible and to maintain the fuel injection performance and secure high reliability.

As shown in FIG. 5, the diesel engine 40 is equipped with the filter 14 interposed between the three-way valve 41 and the injection pump 15. Thus, even if the return fuel is mixed with a foreign matter, the filter 14 removes the foreign matter, which is not supplied to the injection system 12. It is also possible to separate bubbles from the return fuel and avoid air ration in the injection system 12. These advantages are the same as those brought about by the diesel engine 25 of the third embodiment.

Figure 6:
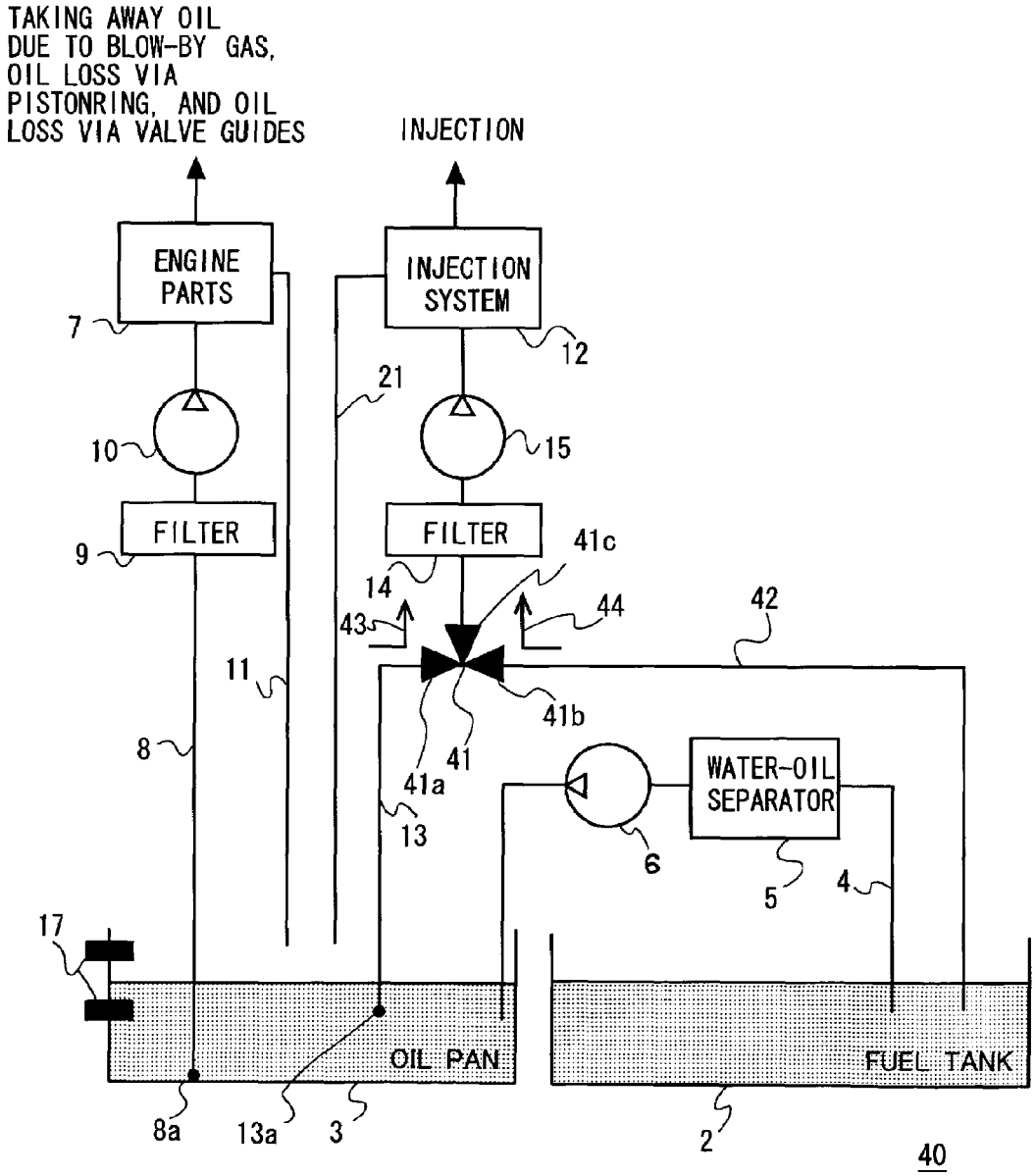
FIG. 6 illustrates another diesel engine lubricated with fuel in accordance with the fifth embodiment of the present invention.

In the structure shown in FIG. 5, the return fuel from the injection system 12 is returned to the fuel tank 2 via the injection-system return passage 16. Alternatively, as shown in FIG. 6, the return fuel may be returned to the oil pan 3 via an injection-system return passage 21. This prevents hot fuel from being returned to the fuel tank 2 and makes it possible to pump up fuel at a lower temperature from the fuel tank 2 via the fuel pipe 42.

The other structures of the diesel engine 40 are the same as corresponding those of the diesel engine 1. Thus, the parts commonly used in the diesel engines 1 and 40 are given the same reference numerals, and a description thereof will be omitted.

Figure 7:
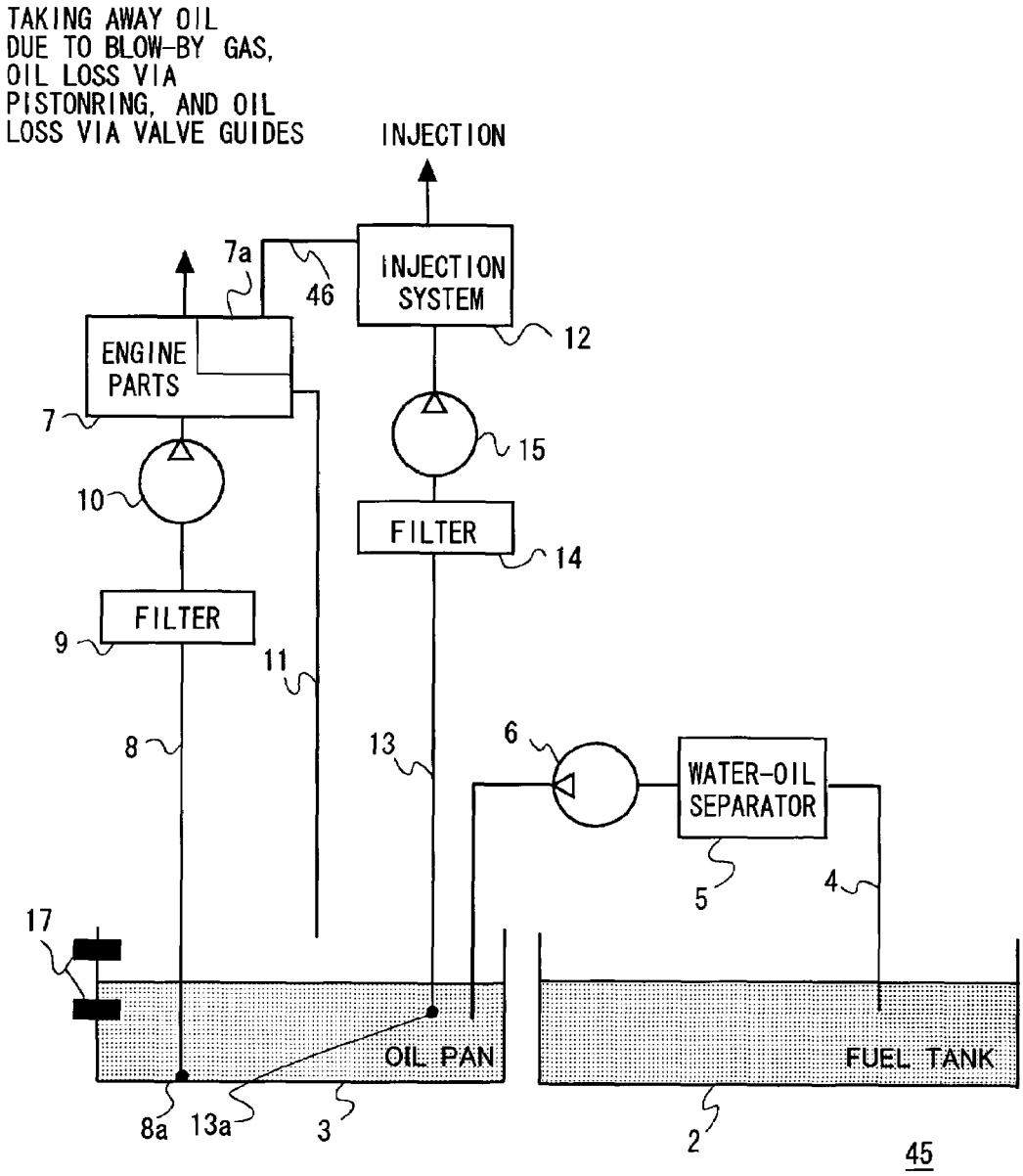
FIG. 7 illustrates a diesel engine lubricated with fuel in accordance with a sixth embodiment of the present invention.

FIG. 7 illustrates a diesel engine 45 in accordance with a sixth embodiment of the present invention. The diesel engine 45 differs from the diesel engine 20 of the second embodiment in the following. The diesel engine 20 has the injection-system return passage 21 via which the return fuel from the injection system 12 is returned directly to the oil pan 3. In contrast, the diesel engine 45 has an injection-system fuel return passage 46 via which the return fuel from the injection system 12 is supplied to a valve train 7*a* among the engine parts 7, and is then returned to the oil pan 3 via the lubrication-system fuel return passage 11.

More specifically, the diesel engine 20 of the second embodiment is designed to supply, via the lubrication-system fuel supply passage 8, fuel to all parts (engine parts 7) that need a supply of lubricating oil such as the valve train 7*a* and the peripheral portion of the crankshaft. In contrast, the diesel engine 45 is designed so that the engine parts 7 are separated into the valve train on the cylinder head side and the periphery of the crankshaft on the cylinder block side. The valve train 7*a* is supplied with the return fuel from the injection system 12, and the cylinder block is supplied with fuel from the lubrication-system fuel supply passage 8.

The return fuel from the valve train 7*a* is merged with the lubrication-system fuel return passage, and is returned to the oil pan 3.

With the above-mentioned structure, the injection-system fuel return passage 46 can be shortened, and a reduced number of parts may be used. There is no need to extend the pipe of the lubrication-system fuel return passage 11 up to the valve train 7*a*, so that the return passage 11 can be simplified.

The other structures of the diesel engine 45 are the same as corresponding those of the diesel engine 20 of the second embodiment. Thus, the parts commonly used in the diesel engines 20 and 45 are given the same reference numerals, and a description thereof will be omitted.

Figure 8:
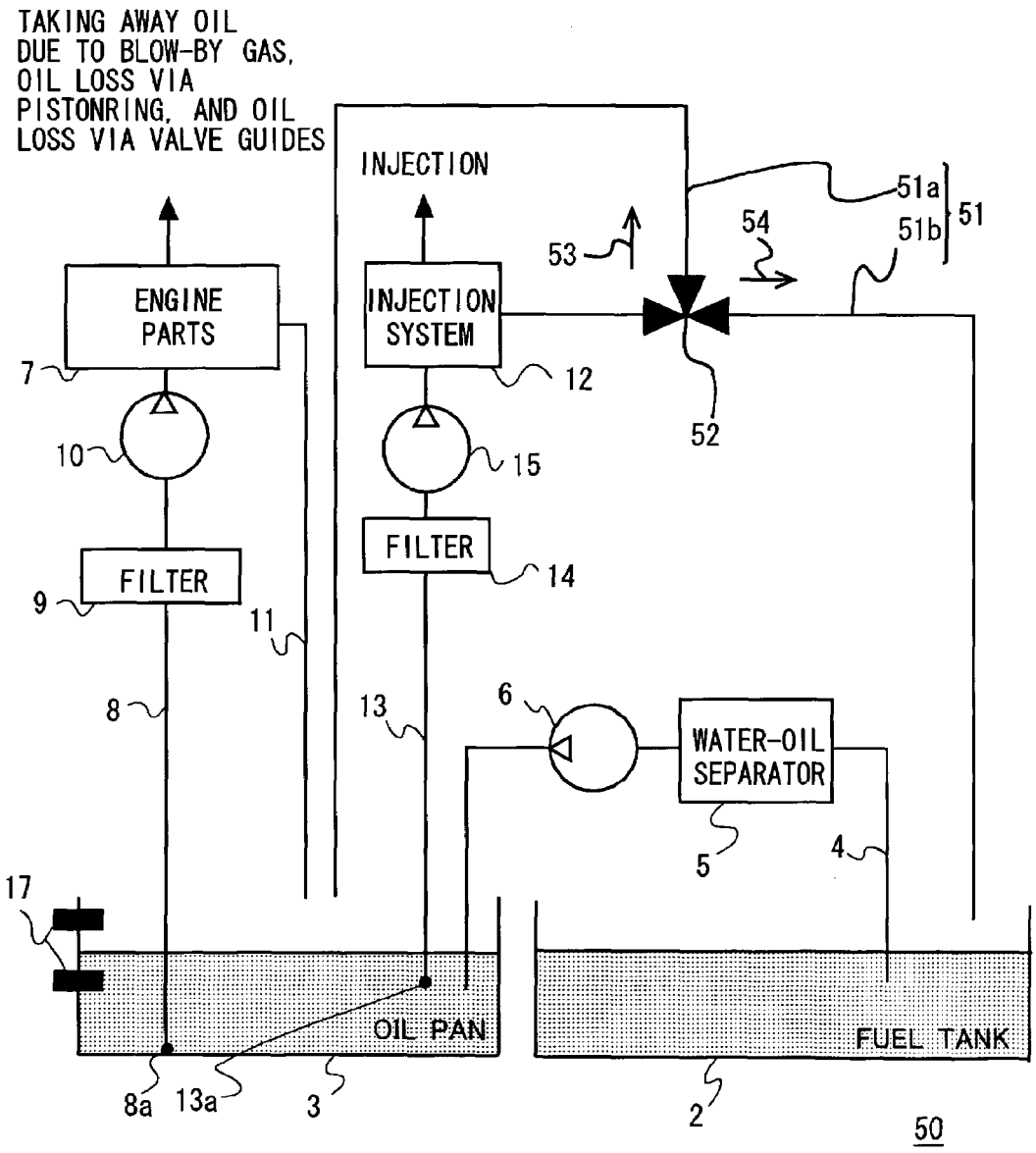
FIG. 8 illustrates a diesel engine lubricated with fuel in accordance with a seventh embodiment of the present invention.

FIG. 8 illustrates a diesel engine 50 in accordance with a seventh embodiment of the present invention. The diesel engine 50 differs from the diesel engines 1 and 20 of the first and second embodiments in the following. The diesel engine 1 has the injection-system return passage 16 via which the return fuel from the injection system 12 is returned to the fuel tank 2. The diesel engine 20 has the injection-system fuel return passage 21 via which the return fuel from the injection system 12 is returned to the oil pan 3. In contrast, the diesel engine 50 of the seventh embodiment has an injection-system fuel return passage 51 equipped with a three-way valve 52, a first passage 51*a* and a second passage 51*b*. The three-way valve 52 is capable of adjusting the degree of opening. The first passage 51*a* is used to return the return fuel from the injection system 12 to the oil pan 3. The second passage 51*b* is used to return the return fuel from the injection system 12 to the fuel tank 2. The diesel engine 50 can switch the destination of the return fuel between the fuel tank 2 and the oil pan 3 on the basis of the condition of the diesel engine 50.

The three-way valve 52 returns the return fuel from the injection system 12 to the oil pan 3 via the first passage 51*a* when the engine is still cold during the warning up. When the engine is completely warmed up and is hot, the three-way valve 52 returns the return fuel from the injection system 12 to the fuel tank 2 via the second passage 51*b*. In this manner, the return fuel having a high temperature raised during the warming up is returned to the oil pan 3, and raises the temperature of the fuel in the oil pan 3 quickly. This decreases the viscosity of the fuel in the oil pan 3 and contributes to reduction of frictions. Further, the return fuel is returned to the fuel tank 2 after the engine is already warmed up and is hot, so that the return fuel can be cooled through the second passage 51*b* and fuel in the injection system 12 can be maintained in a restrained temperature.

Figure 9:
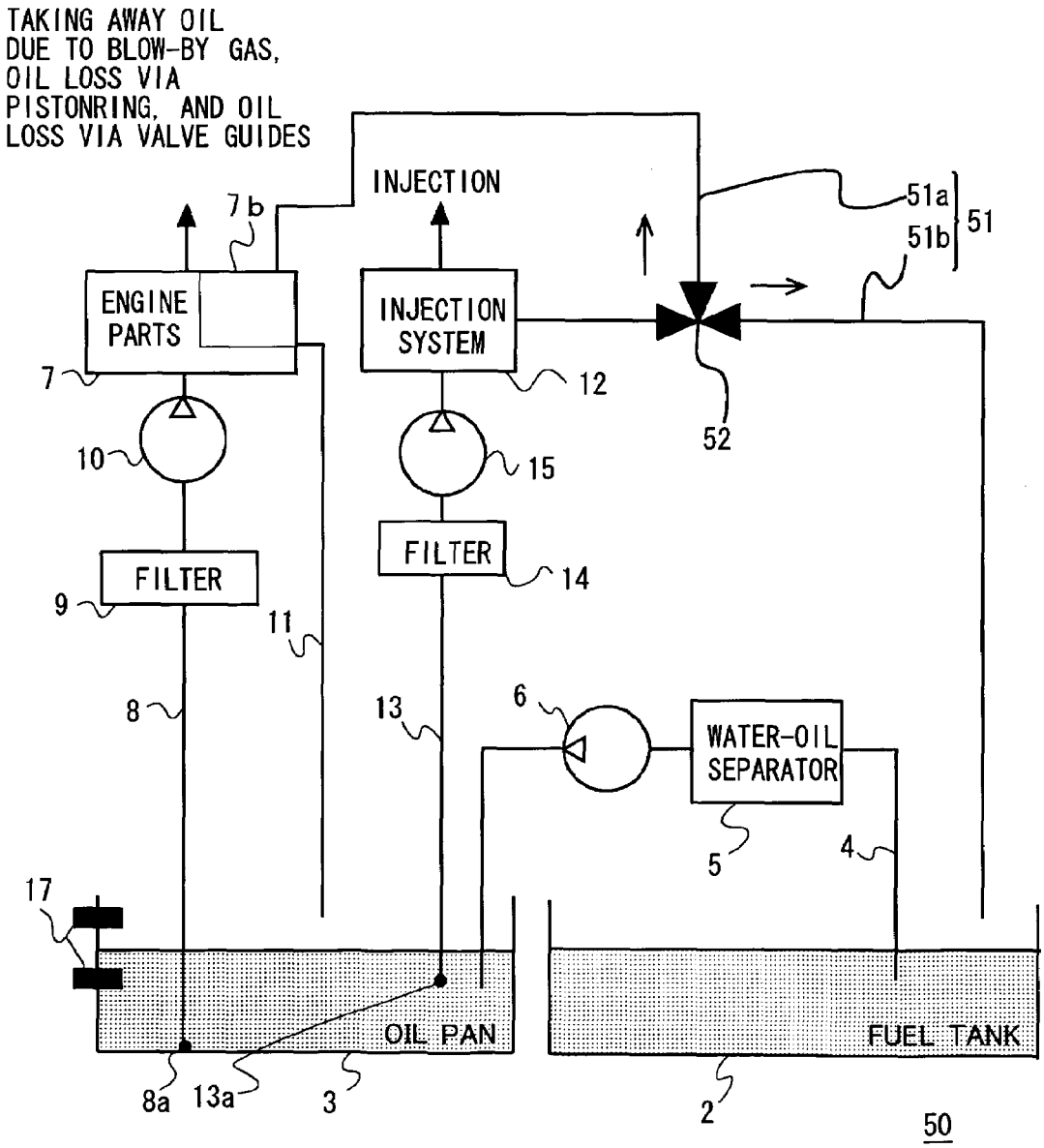
FIG. 9 illustrates another diesel engine lubricated with fuel in accordance with the seventh embodiment of the present invention.

In the structure shown in FIG. 8, the first passage 51*a* directly returns the return fuel from the injection system 12 to the oil pan 3. Alternatively, as shown in FIG. 9, the return fuel may be supplied to primarily lubricated parts 7*b* among the engine parts 7. That is, when the engine is cold, the return fuel that has a raised temperature and a reduced viscosity is directly to the primarily lubricated parts 7*b* such as a crank journal, so that frictions can be reduced quickly.

Figure 10:
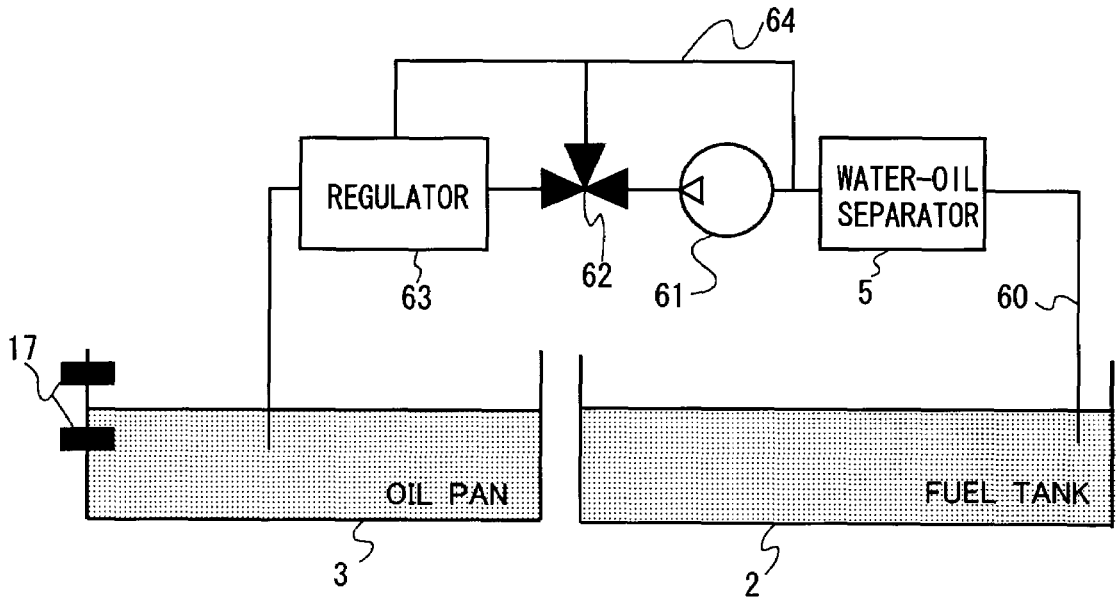
FIG. 10 illustrates a diesel engine lubricated with fuel in accordance with an eight embodiment of the present invention.
Figure 11:
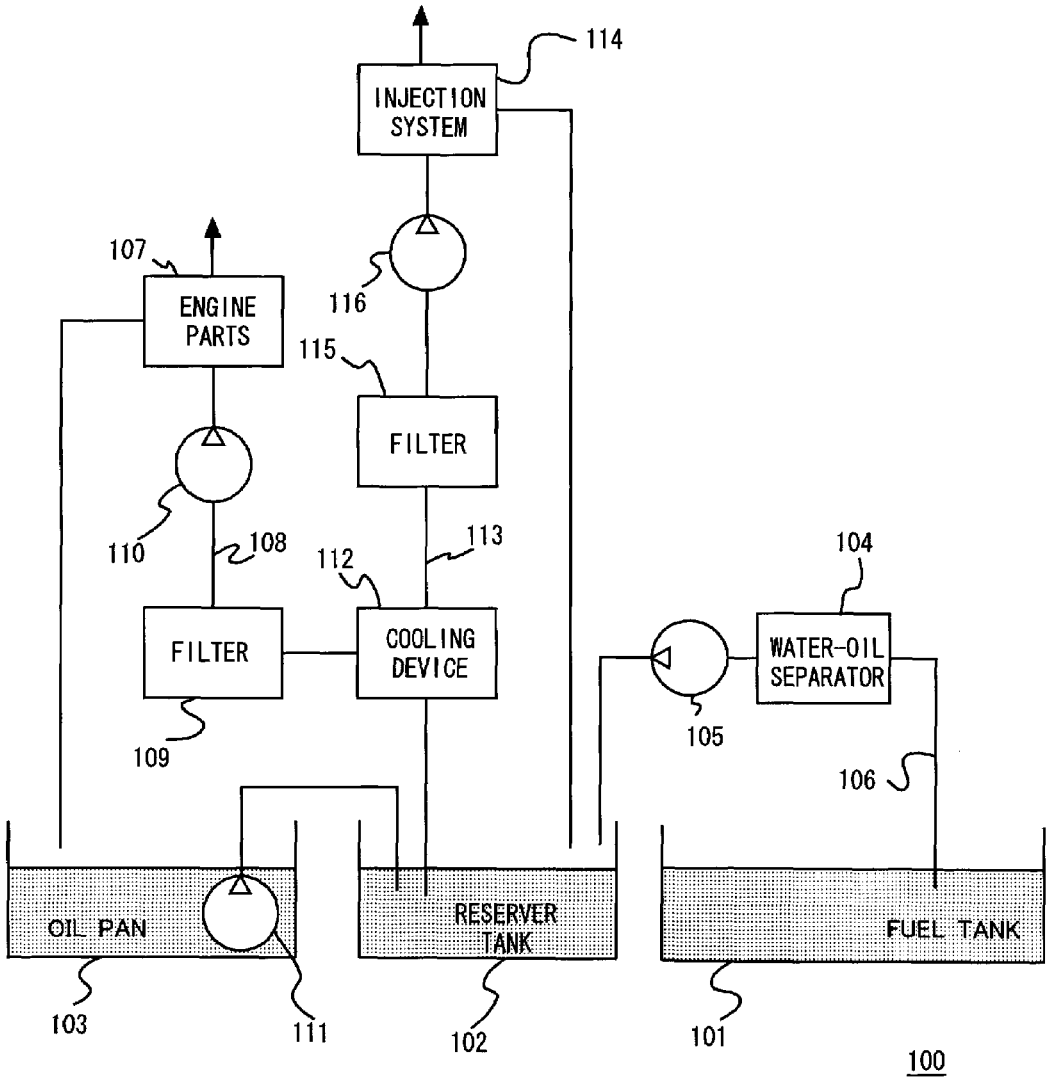
FIG. 11 illustrates a conventional fuel-lubrication diesel engine.

FIG. 10 shows an eight embodiment of the present invention. This embodiment is a variation of the embodiments having the fuel supply passage 4 equipped with the electrically powered supply pump 6. The present variation employs a fuel supply passage 60 equipped with a mechanical supply pump 61. The fuel supply passage 60 has a three-way valve 62 and a regulator 63 arranged in this order toward the downstream side. The three-way valve 62 is capable of adjusting the degree of opening and is equipped with a return pipe 64 via which excessive fuel among the fuel supplied to the three-way valve 62 from the mechanical supply pump 61 is returned to the upstream side of the pump 61.

This structure is employed in view of the following. The mechanical supply pump 61 increases the fuel supply as the engine speed increases. The regulator 63 regulates the fuel supply to the oil pan 3. When the engine speed increases and excessive fuel is supplied by the mechanical supply pump 61, the degree of opening of the three-way valve 62 is adjusted so that the excessive fuel is returned to the upstream side of the mechanical supply pump 61. Thus, the excessive fuel is recycled in the given loop and the restrained amount of fuel can be supplied to the oil pan 3.

While this invention has been described in conjunction with the exemplary embodiments outlined above, various alternatives, modifications, variations, improvements, and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the claims as filed and as they may be amended are intended to embrace all known or later-developed alternatives, modifications, variations, improvements, and/or substantial equivalents.

The invention claimed is:

1. A diesel engine comprising:

a fuel supply passage via which fuel is supplied from a fuel tank to an oil pan through a supply pump;

a lubrication-system fuel supply passage via which fuel is supplied from the oil pan to engine parts to be lubricated through a lubricating oil pump;

an injection-system fuel supply passage via which fuel is supplied from the oil pan to an injection system through an injection pump, a lubrication-system fuel return passage via which return fuel from the engine parts is returned to the oil pan; and an injection-system fuel return passage via which return fuel from the injection system is returned to the fuel tank, wherein the injection-system fuel supply passage includes a three-way valve having an adjustable degree of opening, and a fuel pipe for a supply of fuel from the fuel tank is connected to the three-way valve, wherein the adjustable degree of opening of three-way valve depends on the temperature of fuel.

2. A diesel engine comprising:

a fuel supply passage via which fuel is supplied from a fuel tank to an oil pan through a supply pump;

a lubrication-system fuel supply passage via which fuel is supplied from the oil pan to engine parts to be lubricated through a lubricating oil pump;

an injection-system fuel supply passage via which fuel is supplied from the oil pan to an injection system through an injection pump, a lubrication-system fuel return passage via which return fuel from the engine parts is returned to the oil pan; and an injection-system fuel return passage via which return fuel from the injection system is returned to the fuel tank, wherein a suction port of the injection-system fuel supply passage in the oil pan is located at a position higher than that at which a suction port of the lubrication-system fuel supply passage is located.

3. The diesel engine as claimed in claim 2, wherein the injection-system fuel supply passage includes a three-way valve having an adjustable degree of opening, and a fuel pipe for a supply of fuel from the fuel tank is connected to the three-way valve.

4. A diesel engine comprising:

a fuel supply passage via which fuel is supplied from a fuel tank to an oil pan through a supply pump, the supply pump in the fuel supply passage is a mechanical supply pump driven by a crankshaft;

a lubrication-system fuel supply passage via which fuel is supplied from the oil pan to engine parts to be lubricated through a lubricating oil pump;

an injection-system fuel supply passage via which fuel is supplied from the oil pan to an injection system through an injection pump, a lubrication-system fuel return passage via which return fuel from the engine parts is returned to the oil pan;

an injection-system fuel return passage via which return fuel from the injection system is returned to the fuel tank, a three-way valve and a regulator are arranged in this order toward a downstream side from the mechanical supply pump; and a return pipe is arranged via which excessive fuel from the mechanical supply pump is returned to an upstream side of the mechanical supply pump by controlling the adjustable degree of opening of the three-way valve.

* * * * *